US005213705A

United States Patent [19]

Olson

[11] Patent Number: 5,213,705

[45] Date of Patent: May 25, 1993

[54] ENCAPSULATED HALOGEN BLEACHES AND METHODS OF PREPARATION AND USE

[75] Inventor: Keith E. Olson, Apple Valley, Minn.

[73] Assignee: Ecolab Inc., St. Paul, Minn.

[21] Appl. No.: 660,176

[22] Filed: Feb. 25, 1991

Related U.S. Application Data

[63] Continuation of Ser. No. 323,264, Mar. 15, 1989, abandoned, which is a continuation of Ser. No. 88,507, Aug. 20, 1987, abandoned, which is a continuation of Ser. No. 728,748, Apr. 30, 1985, abandoned.

[51] Int. Cl.[5] ..... C11D 7/56

[52] U.S. Cl. ..... 252/95; 252/92; 252/174.13; 252/186.35; 252/186.36; 252/535; 252/554

[58] Field of Search ..... 252/91, 174.13, 186.35, 252/186.36, 535, 554, 95; 427/213, 212, 214, 215, 220

[56] References Cited

U.S. PATENT DOCUMENTS

| | | | |
|---|---|---|---|
| 3,112,274 | 11/1963 | Morgenthaler et al. | 252/186.35 |
| 3,154,494 | 10/1964 | Speak | 252/96 |
| 3,598,743 | 8/1971 | Coates | 252/99 |
| 3,637,509 | 1/1972 | Brennan | 252/99 |
| 3,650,961 | 3/1972 | Hudson | 252/99 |
| 3,764,569 | 10/1973 | Ali | 252/554 |
| 3,962,106 | 6/1976 | Rubin | 252/99 |
| 3,983,254 | 9/1976 | Alterman | 428/403 |
| 4,003,841 | 1/1977 | Hachmann | 252/94 |
| 4,051,055 | 9/1977 | Trinh | 252/95 |
| 4,126,573 | 11/1978 | Johnston | 252/99 |
| 4,235,732 | 11/1980 | Beyer | 252/103 |
| 4,279,764 | 7/1981 | Brubaker | 252/99 |
| 4,409,117 | 10/1983 | Holmberg | 252/99 |
| 4,655,780 | 4/1987 | Chun et al. | 427/213 |
| 4,741,858 | 5/1988 | Choy et al. | 252/186.36 |

FOREIGN PATENT DOCUMENTS

| | | | |
|---|---|---|---|
| 2406454 | 8/1975 | Fed. Rep. of Germany | 252/174.13 |
| 48/26922 | 8/1973 | Japan | 252/91 |

*Primary Examiner*—Olik Chaudhuri
*Assistant Examiner*—C. Everhart
*Attorney, Agent, or Firm*—Merchant, Gould, Smith, Edell, Welter & Schmidt

[57] ABSTRACT

An active-halogen bleach such as dichloroisocyanurate dihydrate encapsulated in a coating of a synthetic detergent such as sodium octyl sulfonate. The capsule may further comprise an initial coating of a soluble inorganic detergent builder or filler. The capsule is table in highly alkaline environments such as detergent composition.

28 Claims, 1 Drawing Sheet

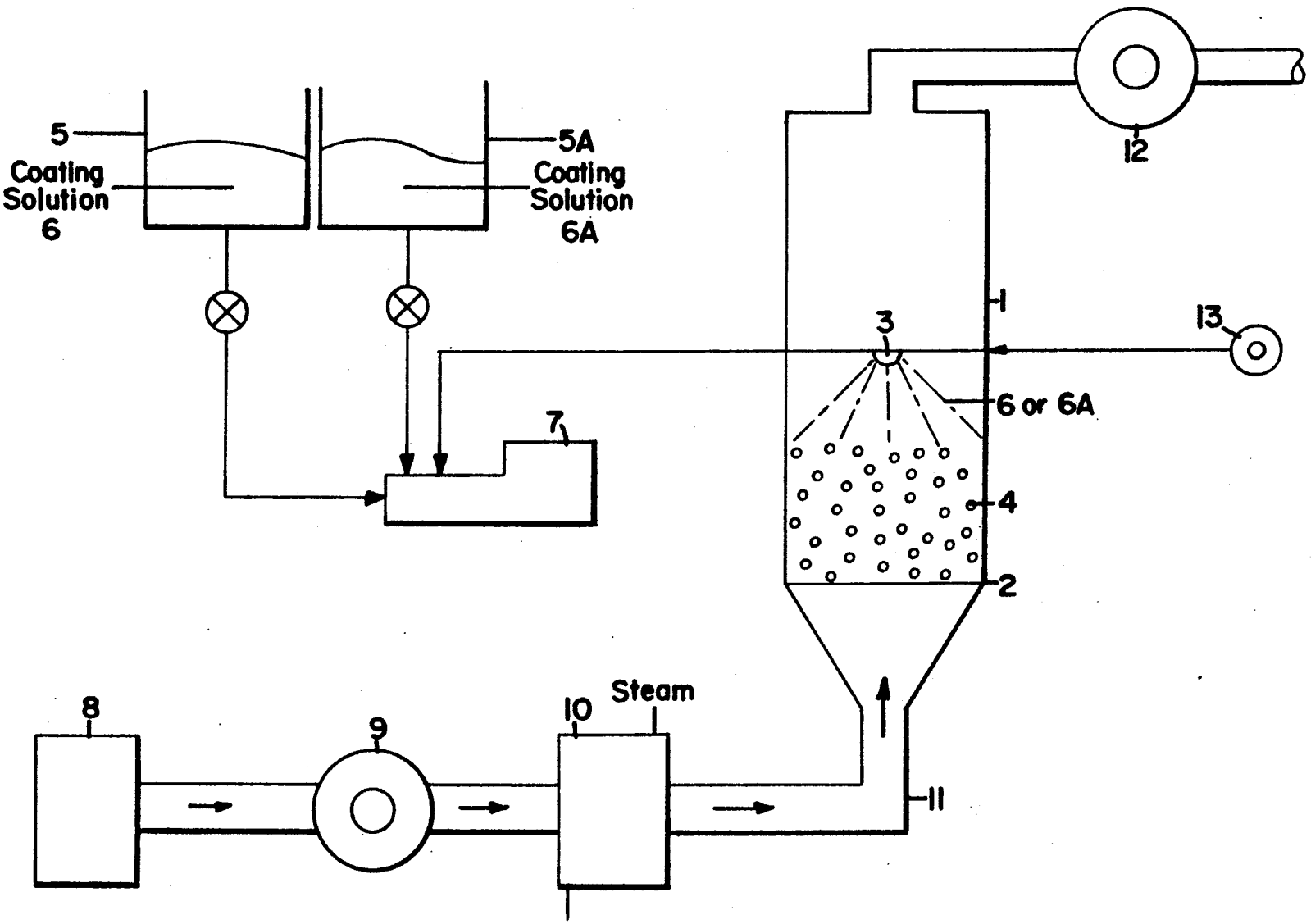
12
13
1
6 or 6A
4
2
3
11
Steam
10
5A
Coating Solution 6A
7
9
5
Coating Solution 6
8

ENCAPSULATED HALOGEN BLEACHES AND METHODS OF PREPARATION AND USE

This is a continuation of application Ser. No. 07/323,264, filed Mar. 15, 1989 which is a continuation of Ser. No. 07/088,507, filed Aug. 20, 1987, which is a continuation of Ser. No. 06/728,748, filed Apr. 30, 1985, all now abandoned.

FIELD OF THE INVENTION

This invention relates to an encapsulating active-halogen bleach composition, and an encapsulating method. The composition provides improved stability of the encapsulated oxidizing active-halogen in an alkaline environment such as in a detergent-bleach composition.

BACKGROUND OF THE INVENTION

The effectiveness of a detergent-bleach composition used in cleaning will vary depending on the temperature of the washing solution, the nature of the soil being removed, the nature and concentration of the active cleaner contained in the solution, hardness of the water and the like. One important consideration, in maintaining an effective concentration of bleach, is the stability of the bleach in the detergent-bleach composition. Typically, a halogen bleach in a detergent-bleach cleaning composition can react with other components in the cleaning composition such as sodium hydroxide and free moisture. This reaction during storage can result in a substantial loss of active-halogen and can result in a corresponding loss in the concentration of other cleaning components.

Many encapsulating procedures known in the art suggests coating a particle of bleach to isolate it from other reactive components in a cleaner. However, many of these encapsulated bleaches are not stable in highly alkaline environments. Further, encapsulating compounds such as tetrapotassium phosphate, hydrateable inorganic salts and fatty acids 12–22 carbon atoms must dissolve to release the active halogen. As a result, the encapsulating compounds generally remain in the washing solution and can interfere in either the washing or bleaching process. Further, these encapsulating compounds do not serve any other function other than encapsulating the active-halogen. An encapsulating compound which is also a cleaning compound, as in this invention, eliminates the introduction of unwanted compounds into the washing solution and reduces the cost of the detergent-bleach compositon.

Encapsulation of an active-halogen source with a single inorganic coating is known in the art. One example of such a composition is taught by Brubaker, U.S. Pat. No. 4,279,764. Brubaker discloses a bleaching composition containing a chlorine bleaching agent coated with a silicate bound, hydrated, soluble salt containing an N-H chlorine accepting component. Brubaker discloses the prepared composition to be useful in preventing dye and fabric damage caused by bleach during machine washing of fabrics. Brennan, U.S. Pat. No. 3,637,509, discloses an encapsulated mixture of an organic chlorinating agent and an alkali metal tripolyphosphate encapsulated by tetrapotassium phosphate. Brennan discloses that the composition provides an improved stability with respect to the available chlorine. Hudson, U.S. Pat. No. 3,650,961, discloses a method of encapsulating a core component in a hydrateable inorganic salt by means of a fluidized bed. Hudson notes that wherein the core component is, for example, a chlorocyanurate the composition is useful in detergent mixtures wherein the composition exhibits excellent chemical and physical stability. Alterman, U.S. Pat. Nos. 3,983,254, and 3,908,045, disclose an encapsulated composition and a process for making the composition, wherein the composition comprises an encapsulated core and a coating of a fatty acid having 12–22 carbon atoms and, when the core is a chlorine releasing agent, with a second coating of a fixed alkali hydroxide. The Alterman patents note that the composition is effective in preventing pinholing by the bleach.

Accordingly, a substantial need exists for an oxidizing halogen source that is stable in a highly alkaline environment, does not substantially degrade other cleaning components, and does not introduce unwanted and unnecessary components.

SUMMARY OF THE INVENTION

I have found that the problem of stabilizing a bleach in an alkaline environment such as a detergent-bleach composition may be solved by encapsulating the bleach in a coating of a synthetic detergent or in a double coating of a soluable inorganic coating agent followed by a synthetic detergent. I have found that a double coating is not always required and that the application of a single coating of a synthetic detergent can in certain instances fully isolate the halogen source. However, we have found that the isolation of the halogen source can be assured by applying two coatings to the halogen core, a first coat of an inorganic coating agent and a second coat of a synthetic detergent. The intermediate inorganic coating agent layer isolates the synthetic detergent from the halogen to insure that any minimal degradation is avoided and promotes adherence of the synthetic detergent coating to the active-halogen core. Preferably the detergent and inorganic builder are used in the cleaning composition in which the encapsulated halogen source is combined.

A first aspect of the invention is an encapsulated halogen bleach wherein the encapsulant prevents any substantial reaction between the halogen bleach composition and the other cleaning components. The halogen bleach has a single coating of synthetic detergent to prevent reaction of the bleach with the other components, wherein the synthetic detergent coating also aids in the cleansing process. In a second embodiment, the halogen bleach is encapsulated by a first layer of an inorganic coating agent and a second layer of a synthetic detergent.

In a third embodiment, the invention provides a method for making the encapsulated halogen bleach source.

For the purposes of this application, a "halogen bleach", or "active-halogen" encompasses active-halogen containing oxidization and bleaching compositions which are capable of releasing one or more oxidizing halogen species (typically —OCL—).

For purposes of this application a "coating agent" as used herein, encompasses soluble inorganic compounds used as inert fillers in detergent compositions and soluble inorganic builders used in detergent compositions which contribute to the detergency of the composition, which do not substantially react with a halogen-bleach.

BRIEF DESCRIPTION OF THE DRAWING

FIG. 1 shows a schematic diagram of the apparatus for carrying out the invention.

DETAILED DESCRIPTION OF THE INVENTION

The encapsulated sources of halogen of this invention comprise a core of an active halogen compound and at least one coating layer. Preferably the encapsulated sources of halogen have a core and two or more coating layers. If one layer is used it comprises a coating of a synthetic detergent. If two layers are used the first layer comprises a coating agent and the second layer comprises a synthetic detergent.

HALOGEN SOURCE

The halogen releasing substances suitable as a core material include halogen components capable of liberating active halogen species such as a free elemental halogen or —OX— wherein X is Cl or Br, under conditions normally used in detergent-bleaching cleaning processes. Preferably the halogen releasing compound releases chlorine or bromine species. The most preferred halogen releasing compound releases chlorine. Chlorine releasing compounds include potasium dichloroisocyanurate, sodium dichlorisocyanurate, chlorinated trisodiumphosphate, calcium hypochloride, lithium hypochloride, monochloramine, dichloroamine, [(monotrichloro)-tetra (monopotassium dichloro)]pentaisocyanurate, 1,3-dichloro-5,5-dimethyl hydantoin,paratoluene sulfondichloro-amide, trichloromelamine, N-chlorammeline, N-chlorosuccinimide, N,N'-dichloroazodicarbonamide, N-chloro-acetyl-urea, N,N'-dichlorobiuret, chlorinated dicyandiamide, trichlorocyanuric acid, and dichloroglycoluril.

Dichloroisocyanurate dihydrate, the most preferred oxidizing chlorine source suitable as a core substance, is commercially available and may be obtained from Monsanto or FMC. The chemical structure of this compound is represented by the formula:

$$NaCl_2C_3N_3O_3.2H_2O$$

SYNTHETIC DETERGENT

The synthetic detergent compound coating must remain sufficiently solid at temperatures likely to be encountered during storage of the product, for example, temperatures of about 15° to 50° C., and also remain stable at temperatures likely to be encountered during processing of the product into end use mixtures, for example, temperatures of about 15° to 95° C.

Synthetic detergents that can be used include anionic, cationic, nonionic and amphoteric detergent compositions. Examples of anionic detergents useful in the detergent-bleach compositions of the invention are the higher alkyl mononuclear aromatic alkali-metal sulfonates, such as alkylbenzenesulfonates having about 9 to about 13 carbon atoms in the alkyl group wherein the alkyl group is derived from polypropylene as described by Lewis in U.S. Pat. No. 2,477,382, or wherein the alkyl group is a hexene dimer or trimer as in McEwan U.S. Pat. No. 3,370,100, or wherein the alkyl group is derived from alphaolefins, as in Swenson U.S. Pat. No. 3,214,462. Also there may be employed primary and secondary alkyl sulfates.

A particularly suitable synthetic detergent for use as a coating in the present invention is preoxidized sodium octyl sulfonate. The sodium octyl sulfonate may contain 1,2 alkane bisulfonate as a byproduct of manufacture which does not affect the performance of sodium octyl sulfonate as a coating in the invention.

The organic compound coating is applied as a solution in a suitable solvent, water being preferred because of its compatibility and non-reactivity with chlorine releasing agents, non-flamability, and non-toxicity.

The compositions of the present invention may be formulated with a detergent builder as a detergency aid, for example, those mentioned hereinafter, to provide a commercially valuable detergent-bleach composition.

SOLUBLE INORGANIC COATING AGENT

Inorganic fillers suitable for coating agents include: Alkalies such as sodium bicarbonate, sodium sequicarbonate, sodium borate, potassium bicarbonate, potassium sequicarbonate, potassium borate; Phosphates such as diammonium phosphate, monocalcium phosphate monohydrate, tricalcium phosphate, calcium pyrophosphate, iron pyrophosphate, magnesium phosphate, monopotassium orthophosphate, potassium pyrophosphate, dry, disodium orthophosphate, dihydrate, trisodium orthophosphate, decahydrate, tetrasodium pyrophosphate, sodium tripolyphosphate, sodium phosphate glass; Neutral soluble salts such as sodium sulfate and sodium chloride; Silicates; Organic sequestering agents; and Antiredeposition Agents.

Suitable builder compounds are tetrasodium and tetrapotassium pyrophosphate, pentasodium and pentapotassium tripolyphosphate, sodium or potassium silicates, hydrated or anhydrous borax, sodium or potassium sesquicarbonate, phytates, polyphosphonates such as sodium or potasium ethanel-hydroxy-1, 1-diphosphonate etc.

When carrying out the process of the instant invention, the protective passivation coating of the invention is conveniently applied by means of the apparatus shown schematically in FIG. 1. Referring to the drawings, a coating chamber or cylindirical tower 1 is shown, wherein the coating or encapsulation of the particles is accomplished. At the base of tower 1 is distributor plate 2. An unexpanded bed of the particles to be coated is contained in the tower 1. A downwardly projecting nozzle 3 constituting a spraying means is adjustably disposed within the tower 1, and adapted to be adjusted vertically so that the liquid droplets of coating material 6, discharged in a downardly diverging three-dimensional spray pattern, would just cover the upper surface area of the bed.

The coating solution is contained in vessel 5 and is fed to nozzle 3 by pump 7. The spraying of the coating solution 6 from nozzle 5 may be aided by pressurized air entering tower 1 at inlet 13. Fluidizing gas passes through duct 11 and is forced through the distributor plate 2 by blower 9 and is either cooled by cooling system 8, or heated by heat exchanger 10, if required, in order to maintain the fluidizing gas within a desored temperature range. An exhaust blower 12 removes solvent vapors.

A known weight of a multiplicity of particles to be coated is placed on the distributor plate 2. Air is caused to flow upwardly by the force created by blower 9 through duct 11, thereby expanding the thickness of the layer of particles, and maintaining the particles in continous motion within the volume defined by the expanded bed, thus forming a fluidized bed 4. A solution of a solidifiable coating substance 6, contained in vessel 5, is sprayed by means of pump 7 through nozzle 3 on the fluidized bed 4 until all particles in the bed are completely coated. Particles coated by the above-described procedure are completely encapsulated with a continous coating, and are free-flowing and nonagglomerated.

It is important that each particle be fully covered to prevent the oxidizing halogen source from reacting with an alkaline environment.

When it is desired to apply an initial coating of a coating agent and a subsequent coating of a synthetic detergent, the double coating may be conducted in a single fluidized bed either by applying the first coat, emptying the solution tank 6, filling the solution tank 6 with the second coating solution and then applying the second coat; or with a dual coating solution inlet to the atomizer as shown in FIG. 1 by coating solution 5A, coating solution tank 6A and the pipes leading from 6A to the pump 7, the fluidized particles in the bed first being coated with the coating agent contained in solution tank 5, this first coating being allowed to dry and then a second coating of the synthetic detergent contained in solution tank 5A being applied, both coatings being conducted in accordance with the previous discussion on the operation of the fluidized bed.

A third method of applying a double coating in a fluidized bed is to coat the core particles with the coating agent in a first fluidized bed apparatus. The coated material then allowed to dry and placed in a second fluidized bed apparatus, wherein the encapsulated product produced in the first fluidized bed is coated with a second coating solution of a synthetic detergent. The fluidized bed operation conducted in accordance with the prior discussion of the operation of the fluidized bed.

Before removal of the encapsulated oxidizing chlorine source from the fluidized bed the temperature in the bed can be increased so as to drive off any solvent remaining in the encapsulate. However, the temperature must remain below the melting temperature of the encapsulant and below the degradation temperature of the encapsulated core.

The encapsulated halogen bleach sources of the present invention comprise about 20 to 90 wt. % halogen bleach source core and about 10 to 80 wt. % synthetic detergent coating when a single coating is utilized and about 20 to 90 wt. % halogen bleach source core, about 0.5 to 50 wt. % inorganic coating agent first coat, and about 5 to 70 wt. % synthetic detergent second coating when a double coating is utilized.

More particularly, the single coated halogen bleach source comprises about 30 to 80 wt. % halogen bleach source core and about 20 to 70 wt. % synthetic detergent coating and most particularly about 40 to 55 wt. % halogen bleach source core and 45 to 60 wt. % synthetic detergent coating.

A more preferred embodiment of the double coated halogen bleach source comprises about 30 to 80 wt. % halogen bleach source core, about 5 to 50 wt. % inorganic coating agent first coating, and about 5 to 50 wt. % synthetic detergent second coating. In a most preferred embodiment, the encapsulate comprises about 30 to 60 wt. % halogen bleach source core, about 15 to 45 wt. % inorganic coating agent first coating, and about 10 to 35 wt. % synthetic detergent second coating.

The detergent compositions with which the encapsulated bleaching agents of the invention find utility may have compositions represented by the following components and ranges of proportions hereof:

| | Approximate Percentage |
|---|---|
| Anionic or Nonionic Detergent | 1-90% |
| Organic and/or Inorganic Builders (including alkaline builders) | 0-95% |
| Encapsuated Bleaching Agent | 0.5-25% |
| Optical Brightener | 0-0.3% |
| Water | 5-50% |
| Filler | 0-25% |

The encapsulated bleaching agents of the invention find particular utility in combination with solid cast highly alkaline detergent compositions.

Other materials which may be present in the detergent compositions of the invention are those conventionally employed therein. Typical examples include the well-known soil suspending agents, corrosion inhibitors, dyes, perfumes, filers, optical brighteners, enzymes, germicides, anti-tarnishing agents, and the like. The balance of the detergent composition may be water.

The invention may be more fully understood by reference to the following examples which include a best mode.

EXAMPLE 1

This example describes a single coating process within the invention.

Ten pounds of the encapsulated oxidizing halogen source is made from 5.71 lbs. of granular diochloroisocyanurate dihydrate with particle sizes of about 10 to 60 U.S. Mesh. The particles are placed onto the distributor plate of the cylindrical coating tower 1 (FIG. 1). The particles are fluidized and suspended by an upwardly moving air stream supplied by blower 10. The temperature of the bed maintained between 43° and 83° C.

The coating solution is prepared by dissolving 5.55 lbs of 40% sodium octyl sulfonate in 5.55 lbs. of soft water.

The coating solution is sprayed on the fluidized particles 3, through nozzle 5, appropriately adjusted as to height.

The coating solution is applied to the fluidizing particles for a period of about 1 hour. The coated particles being of substantially uniform size and being dry and free flowing. The coated particles comprising about 60 to 85 wt. % dichloroisocyanurate dihydrate.

EXAMPLE 2

This example describes a dual coating process within the invention.

Ten pounds of the encapsulated oxidizing chlorine source was made from 5.71 lbs of granular diochloroisocyanurate dihydrate with particle sizes of about 10 to 60 U.S. Mesh. The particles were placed onto the distributor plate of the cylindrical coating tower 1 (FIG. 1). The particles were fluidized and suspended by an upwardly moving air stream supplied by blower 10.

The temperature of the bed maintained between 43° and 83° C. throughout the coating process.

The first coating solution was prepared by dissolving 2.71 lbs. of sodium sulfate and 0.90 lbs. of sodium tripolyphosphate in 11.3 lbs. of soft water. The first coating solution was sprayed on the fluidized particles 3, through nozzle 5, appropriately adjusted as to height.

The first coating solution was applied to the fluidized particles for a period of about 1 hour. The coated particles being of uniform size and being dry and free flowing.

The second coating solution was prepared by dissolving 5.55 lbs. of 40% sodium octyl sulfonate in 5.55 lbs. of soft water. The second coating solution was sprayed on the fluidized particles in the same manner as the first coating was sprayed onto the core particles.

The second coating solution was applied to the fluidized particles for a period of about 1 hour. The coated particles being of substantially uniform size and being dry and free flowing.

After addition of the second coating the bed temperature is allowed to rise to about 180° F. to assure that no free moisture is left in the encapsulate.

The encapsulates are then allowed to cool to less than 110° F. and discharged from the system.

The specification and examples are presented above to aid in the complete non-limiting understanding of the invention. Since many variations and embodiments of the invention can be made without departing from the spirit and scope of the invention, the invention resides in the claims hereinafter appended.

I claim:

1. An encapsulate halogen bleach composition that is chemically stable and compatible when combined with an alkaline cleaning composition and does not interfere with the action of the cleaning composition, the capsule comprising:

(a) a halogen bleach core; and (b) an encapsulating coating effective to isolate the core, wherein the core comprises about 20 to 90 wt-% of the encapsulate composition and the coating comprises about 10 to 80 wt-% of the encapsulate composition, said coating comprising, (i) a first coating layer of an inorganic agent coated over said bleach core, and (ii) a second coating layer of an n-alkyl sulfonate compound coated over said inorganic agent.

2. The composition of claim 1 wherein the core comprises a source of active-chlorine.

3. The composition of claim 1 wherein the core comprises a dichloroisocyanurate compound.

4. The composition of claim 1 wherein the n-alkyl sulfonate compound comprises an alkali metal octyl sulfonate.

5. The composition of claim 1 wherein:

(a) the core comprises about 30 to 70 wt. % of a dichloroisocyanurate dihydrate compound based upon the composition; and (b) the second coating layer comprises an octyl sulfonate compound.

6. The composition of claim 1 wherein:

(a) the core comprises about 40 to 55 wt. % of a dichloroisocyanurate dihydrate based upon the composition; and (b) the coating comprises a sodium octyl sulfonate.

7. An encapsulate chlorine bleach composition that is chemically stable and compatible when combined with an alkaline cleaning composition, and does not interfere with the action of the cleaning composition, the capsule comprising a chlorine bleach core and two encapsulating coatings effective to isolate the core, wherein the core comprises about 20 to 89.5 wt-% of the encapsulate composition, the first coating, which is a soluble inorganic coating agent comprises about 0.5 to 50 wt-% of the encapsulate composition, and the second coating comprises an n-alkyl sulfonate compound at a concentration of about 10 to 70 wt-% of the encapsulate composition.

8. The composition of claim 7 wherein the core comprises a source of active-chlorine.

9. The composition of claim 7 wherein the core comprises a dichloroisocyanurate compound.

10. The composition of claim 7 wherein the first coating comprises a builder salt.

11. The composition of claim 7 wherein the first coating is a member selected from the group consisting of an alkali metal phosphate compound, sodium sulfate and mixtures thereof.

12. The composition of claim 7 wherein the n-alkyl sulfonate comprises an alkali metal octyl sulfonate.

13. The composition of claim 7 wherein:

(a) the core comprises about 35 to 60 wt. % of a dichloroisocyanurate dihydrate based upon the composition;

(b) the first coating comprises about 15 to 45 wt. % of a mixture of an alkyl metal tripolyphosphate and sodium sulfate based upon the composition; and (c) the second coating comprises about 10 to 35 wt. % of an n-alkyl sulfonate based upon the composition.

14. A chlorine bleach composition compatible in a cleaning composition, that neither degrades the active components of the cleaning composition or interferes with their action, which consists of an encapsulated composition having a core and two encapsulating coatings effective to isolate the active halogen, wherein:

(a) the core comprises a particle of dichloroisocyanurate dihydrate having a particle size of 10 to 60 U.S. mesh;

(b) the first coating consists of about 15 to 45 wt. % of a mixture of about 10 to 40 wt. % sodium tripolyphosphate and about 60 to 90 wt. % sodium sulfate based upon the composition; and (c) the second coating consists of about 10 to 35 wt. % of a sodium octyl sulfonate based upon the composition.

15. A process for encapsulating a halogen bleach which comprises the steps of:

(a) forming a fluidized bed of an active halogen core material comprising a source of active halogen having a particle size of about 8 to 120 U.S. mesh;

(b) forming a first coating of a soluble inorganic coating agent on the particles in the bed; and (c) forming a second coating of an n-alkyl sulfonate compound which is substantially inert with respect to the halogen bleach core, on the particles in the bed;

whereby the coating renders the halogen bleach core stable in an alkaline environment.

16. The process of claim 15 wherein the second coating is formed by spraying the n-alkyl sulfonate compound to form the coating.

17. The process of claim 15 wherein the core comprises a source of active chlorine.

18. The process of claim 15 wherein the coating comprises an alkali metal octyl sulfonate.

19. The process of claim 15 wherein the encapsulated halogen bleach is maintained at an elevated temperature after addition of the coating, in order to evaporate any free moisture left in the encapsulate.

20. The process of claim 15 wherein: p1 (a) the core comprises a dichloroisocyanurate compound;

(b) the coating comprises an n-alkyl sulfonate compound; and (c) the fluidized bed is maintained at about 35° to 100° C.

21. The process of claim 15 wherein:

(a) the core comprises about 65 to 90 wt. % of a dichloroisocyanurate dihydrate based upon the composition;

(b) the coating comprises about 10 to 35 wt. % of an n-alkyl sulfonate compound based upon the composition; and (c) the fluidized bed is maintained at about 40° to 80° C.

22. A process for encapsulating a halogen bleach which comprises the steps of:

(a) forming a fluidized bed of a core material, wherein the core material comprises an active halogen component having a particle size of about 8 to 120 U.S. mesh;

(b) forming a first coating of a soluble inorganic coating agent, which is substantially inert with respect to the halogen bleach core, on the particles in the bed; and (c) forming a second coating of an n-alkyl sulfonate compound, which is substantially inert with respect to the halogen bleach core and the first coating, on the particles in the bed, whereby the coating renders the halogen bleach core stable in an alkaline environment.

23. The process of claim 22 wherein the coating are formed by spraying.

24. The process of claim 22 wherein the core comprises a source of active chlorine.

25. The process of claim 22 wherein the first coating is a member selected from the group consisting of alkali metal phosphate components, sodium sulfate and mixtures thereof.

26. The process of claim 22 wherein the encapsulated halogen bleach is maintained at an elevated temperature after addition of the second coating in order to evaporate any free moisture left in the encapsulate.

27. The process of claim 22 wherein:

(a) the core comprises about 30 to 60 wt. % of a dichloroisocyanurate dihydrate based upon the composition;

(b) the first coating comprises about 15 to 40 wt. % of a mixture of an alkali metal tripolyphosphate and sodium sulfate based upon the composition;

(c) the second coating comprises about 10 to 35 wt. % of an n-alkyl sulfonate based upon the composition, (d) the fluidized bed is maintained at about 40° to 80° C. while the first coating is applied; and (e) the fluidized bed is maintained at about 40° to 70° C. while the second coating is applied.

28. The process of claim 22 wherein:

(a) the core comprises about 30 to 60 wt. % of a 10 to 40 U.S. mesh size particle of dichloroisocyanurate based upon the composition;

(b) the first coating comprises about 15 to 45 wt. % of a mixture of about 10 to 40 wt. % sodium tripolyphosphate and about 60 to 90 wt. % sodium sulfate based upon the composition;

(c) the second coating comprises about 10 to 35 wt. % of a sodium octyl sulfonate based upon the composition; and (d) the fluidized bed is maintained at about 40° to 80° C. while both coats are applied.

* * * * *